US005644853A

United States Patent [19]

Dixon

[11] Patent Number: 5,644,853

[45] Date of Patent: Jul. 8, 1997

[54] BROADHEAD ALIGNER

[76] Inventor: Vernon L. Dixon, 107 Skyline Dr., Perry, Okla. 73077

[21] Appl. No.: 643,780

[22] Filed: May 6, 1996

[51] Int. Cl.[6] ..... G01M 1/16

[52] U.S. Cl. ..... 33/506; 33/533; 473/584

[58] Field of Search ..... 33/506, 533, 549, 33/550; 273/416, 419, 421, 422

[56] References Cited

U.S. PATENT DOCUMENTS

| | | | |
|---|---|---|---|
| D. 341,758 | 11/1993 | Egan . | |
| 3,846,998 | 11/1974 | Lock | 33/506 |
| 3,859,728 | 1/1975 | Shutt . | |
| 4,203,308 | 5/1980 | Davis . | |
| 4,497,207 | 2/1985 | Schaaf | 33/506 |
| 4,562,647 | 1/1986 | Bengston . | |
| 4,623,410 | 11/1986 | Hillesheim et al. . | |
| 5,061,008 | 10/1991 | Saunders . | |
| 5,121,549 | 6/1992 | Gadousky, Jr. | 33/533 |
| 5,533,272 | 7/1996 | Bagwell | 33/506 |

*Primary Examiner*—Daniel G. DePumpo
*Attorney, Agent, or Firm*—Chase & Yakimo

[57] ABSTRACT

A device for aligning a broadhead on an arrow shaft supports the shaft for rotation about its axis while the head is received in a centering fixture comprising a block of magnetic material having a tapered recess therein. The block is held by a permanent magnet, and the contacting surfaces of the magnet and block provide a floating mount for the block that permit it to seek a position aligning a broadhead, inserted in the recess, with the associated rotatably supported arrow shaft. Once aligned, the cement that secures the head to the shaft is allowed to harden to secure the head fast to the shaft in the aligned condition.

7 Claims, 4 Drawing Sheets

BROADHEAD ALIGNER

BACKGROUND OF THE INVENTION

This invention relates to a device for aligning the head of an arrow with the axis of the arrow shaft and, in particular, to an alignment device that assures that a broadhead is aligned with the centerline of the shaft to ensure that the flight of the arrow will be true.

In bowhunting an arrow is equipped with a special head ("broadhead") provided with razor-sharp blades for penetrating game and ensuring a clean kill. Present day arrow shafts are typically hollow aluminum or a carbon material to which the broadhead is attached by a projecting insert received by the shaft or a complemental sleeve or outsert that fits over the shaft. However, these couplings do not automatically provide a precision fit as machining tolerances are too great to ensure perfect alignment. A suitable cement bonds the insert or outsert to the arrow shaft and thus may provide a permanent attachment that slightly misaligns the broadhead with the centerline of the arrow shaft.

A misaligned broadhead may be detected by rotating the arrow shaft about its axis or centerline and observing the point of the head. If its wobbles, the broadhead is misaligned. Correction of the condition, however, requires that the cement be softened and then permitted to solidify while the arrow is held in a perfectly aligned condition.

SUMMARY OF THE INVENTION

It is, therefore, the primary object of the present invention to provide a device which both detects misalignment of a broadhead and causes it to move to an aligned position on the shaft of the arrow, and which does not require that measurements be made or that other procedures be undertaken to reliably secure the broadhead in an aligned condition.

As a corollary to the foregoing object, it is an important aim of this invention to provide such a device in which the broadhead is received by a floating centering fixture that seeks a position aligning the arrowhead with its shaft as the shaft is rotated by the operator.

Another important object of this invention is to provide a device as aforesaid in which the centering fixture is held by a magnet at a location in general alignment with the arrow shaft, the fixture and the magnet having contacting surfaces extending transversely of the axis of the shaft to provide a floating mount for the fixture.

Still another important object is to provide such a device in which the fixture comprises a block of material having a tapered recess therein for receiving the broadhead and causing the fixture to move to a position where the received head will be in alignment with the associated rotatably supported arrow shaft.

Other objects will become apparent as the detailed description proceeds.

DETAILED DESCRIPTION

Figure 1:
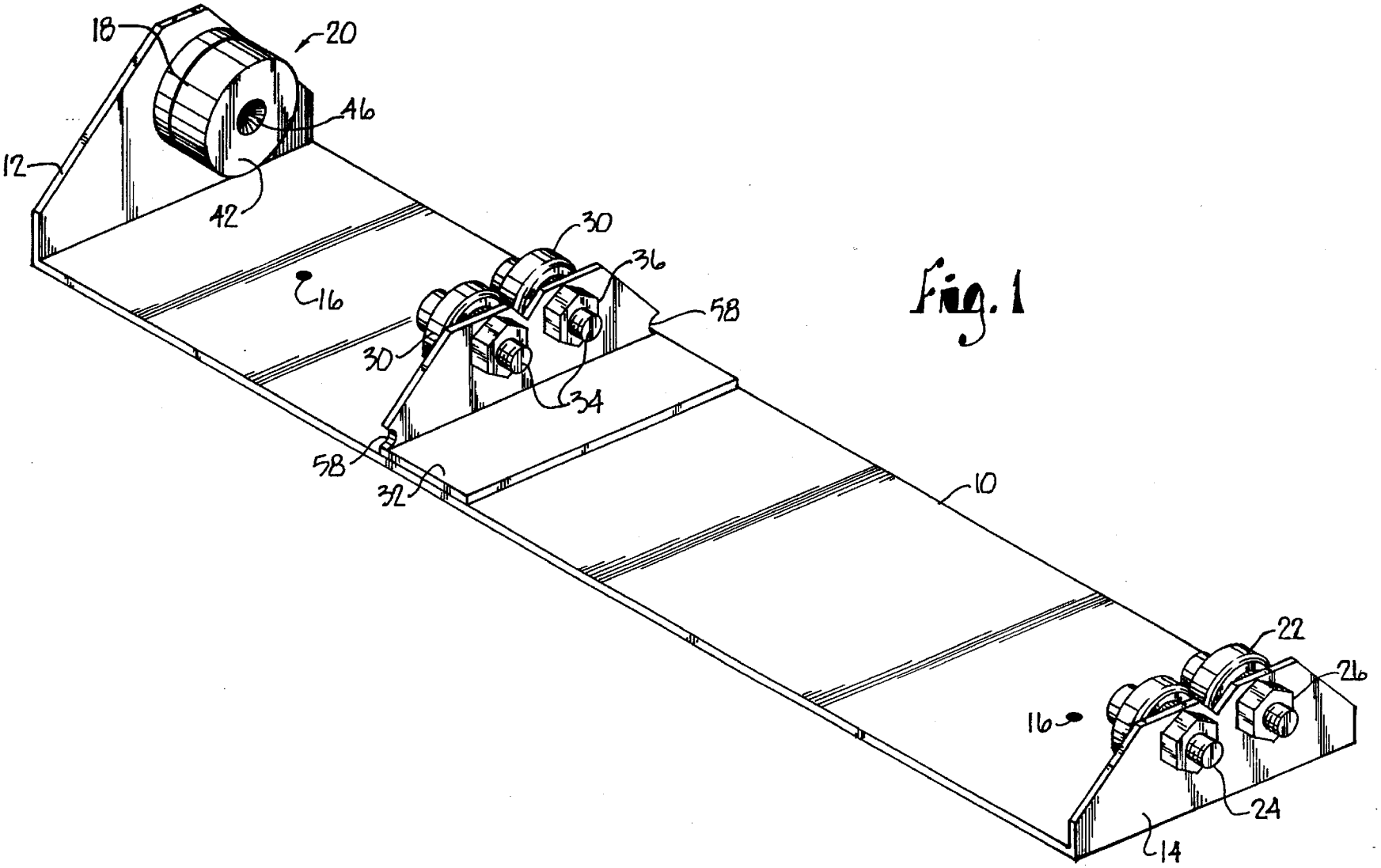
FIG. 1 is a perspective view of the alignment device of the present invention.
Figure 2:
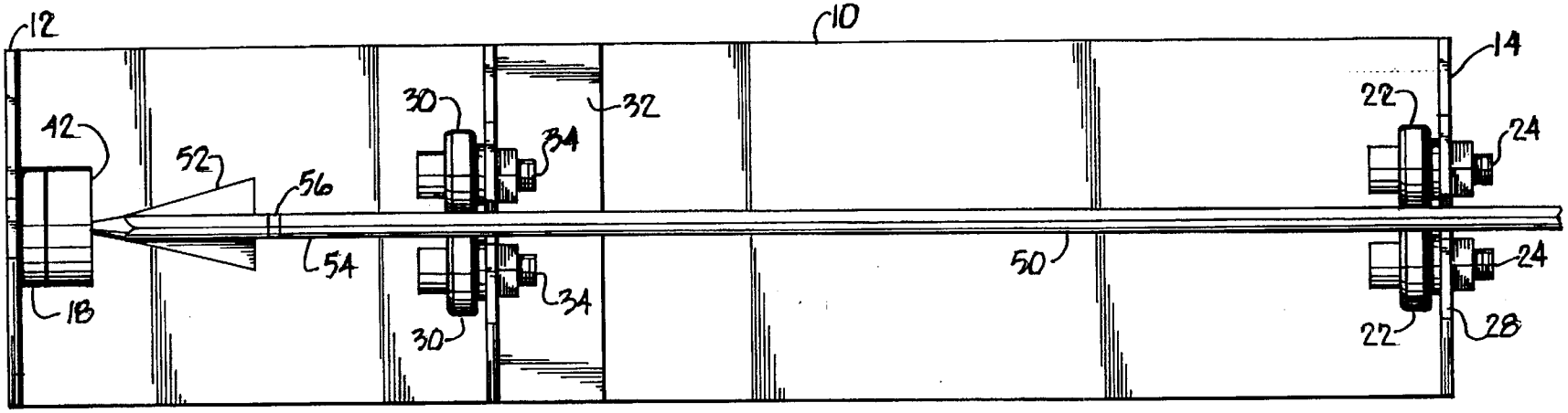
FIG. 2 is a top plan view of the device and shows an arrow received therein.
Figure 3:
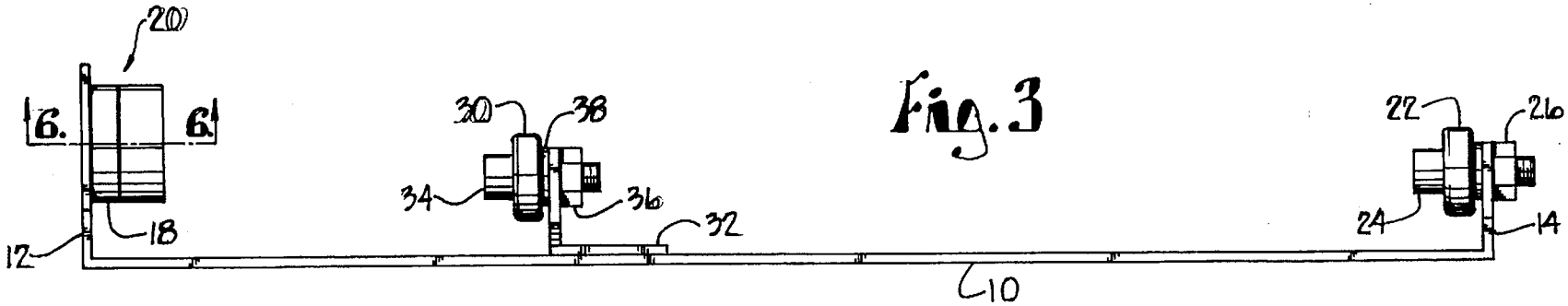
FIG. 3 is a side elevational view of the device.

An elongated, rectangular baseplate 10 has upturned ends presenting a left end wall 12 and a right end wall 14 as viewed in FIGS. 1–3. The baseplate 10 may be secured to a work table or other horizontal supporting surface through the use of mounting holes 16 provided therein. The left end wall 12 presents a substantially vertical surface and supports a disk-shaped permanent magnet 18, one face of which may be secured to the surface of wall 12 by a suitable cement. A centering fixture 20 of magnetic material, such as steel, is provided by a cylindrical block which is held on permanent magnet 18 by magnetic attraction.

The right end wall 14 supports a pair of rollers 22 mounted side-by-side in closely spaced relationship as is apparent from the figures. Each of the rollers 22 (preferably a roller bearing) rotates about an axis provided by a bolt 24 secured to wall 14 by a nut 26 and is spaced therefrom by a washer 28. The bolts 24 are mounted in parallelism and thus provide horizontal, parallel axes about which the rollers 22 may turn.

Similarly, a pair of rollers 30 are mounted at approximately two-thirds of the distance from the right wall 14 to the left wall 12, this being accomplished by an angle bracket 32 secured to baseplate 10. The two rollers 30 are closely spaced, side-by-side and rotate about parallel axes provided by bolts 34 which are aligned with bolts 24 to axially align the two sets of rollers 22 and 30. Each of the bolts 34 is secured by a nut 36, and the associated roller 30 is spaced from bracket 32 by a washer 38.

Figure 4:
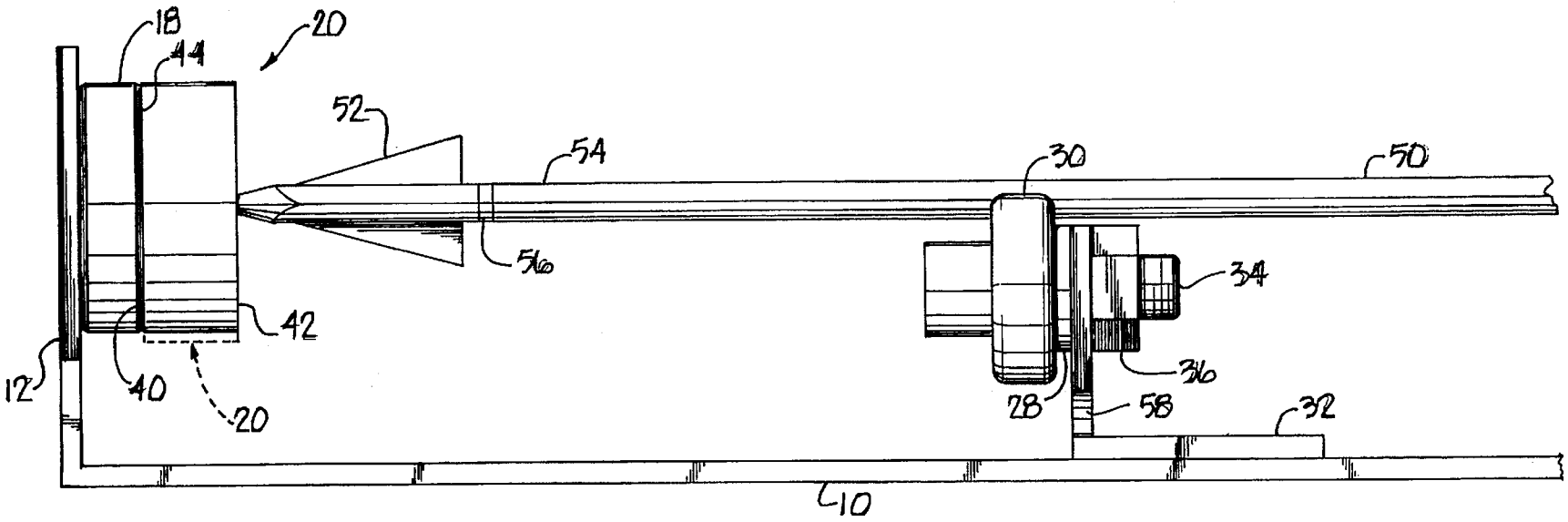
FIG. 4 is a fragmentary view similar to FIG. 3 on an enlarged scale, an arrow also being shown.
Figure 6:
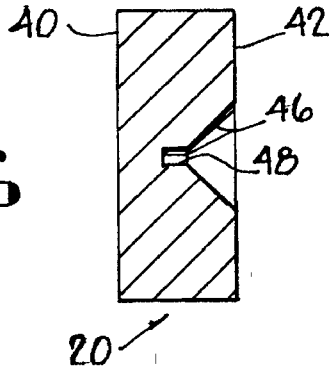
FIG. 6 is an enlarged cross-sectional view of the centering block alone, taken along line 6—6 of FIG. 3.
Figure 5:
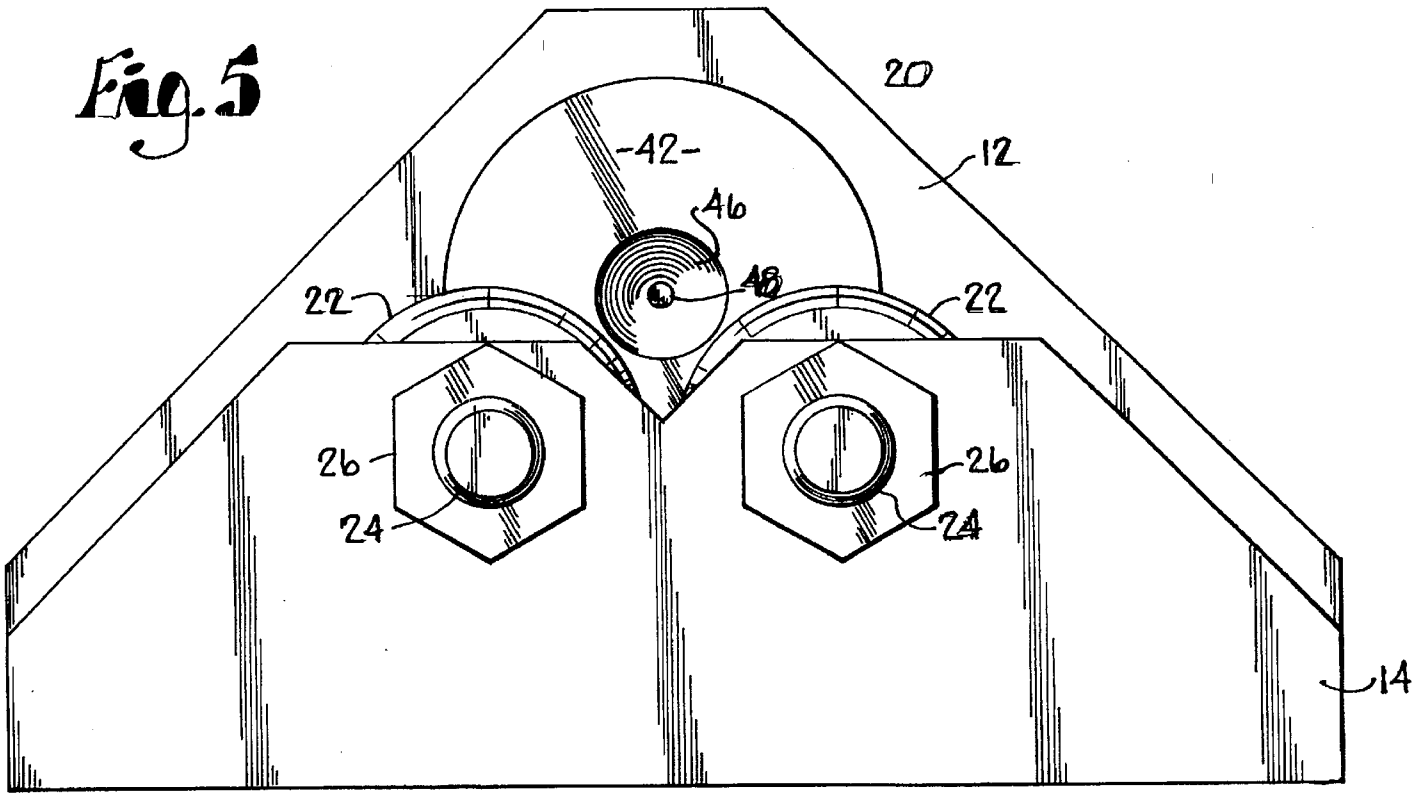
FIG. 5 is an enlarged end view as seen looking at the right end of the device in FIG. 3.

The centering fixture or block 20 is shown in detail in FIG. 6 where it may be seen that it has a pair of opposed, circular surfaces 40 and 42, surface 40 being in intimate, flush contact with the flat, circular surface 44 presented by the permanent magnet 18 (FIG. 4). A central, conical recess 46 in block 20 extends thereinto from surface 42 to a pilot hole 48 drilled in the center of block 20.

Use of the alignment device of the present invention is illustrated in FIGS. 2 and 4 where a portion of the shaft 50 of an arrow is shown fitted with a broadhead 52 for alignment. Those skilled in the art will appreciate that the broadhead 52 is typically provided with an insert that is received by the forward end portion 54 of the hollow arrow shaft 50 and fully inserted until end portion 54 abuts a collar 56 at the head of the insert. Heated hot-melt cement may be used to secure the insert within end portion 54. The arrow is placed in the alignment device with shaft 50 supported on the roller sets 22 and 30. In order to maintain the cement in a melted condition, or melt cement that is in a hardened condition, a small propane torch may be used and the flame applied in the vicinity of end portion 54.

Initially, the user may simply spin the arrow shaft 50 on the rollers 22, 30 and observe the point of the broadhead 52 before inserting it into the block 20. If the point wobbles, the head is not in perfect alignment with the axis or centerline of the arrow shaft 50. To correct the alignment, heat is applied to maintain the cement in a melted condition while forcing the tip of the broadhead 52 into the cone-shaped recess 46 in the block 20. The wobble associated with misalignment forces the block 20 to move against the force of the magnet 18 while the point of the broadhead 52 advances further into the recess 46, ultimately to a position where it is received by the pilot hole 48. It should be appreciated that the flush, contacting surfaces 44 of the magnet 18 and 40 of the block 20 provide a floating mount for the block 20 to permit it to seek a position where the point of the broadhead 52 no longer wobbles as the arrow shaft 50 is spun about its axis. For example, as illustrated by the broken line in FIG. 4, block 20 may be caused to shift slightly downwardly (or in any radial direction) to bring the head 52 and shaft 50 into alignment while the permanent magnet 18 and its associated surface 44 remain stationary. Once alignment is obtained, heat is removed from the cement and it is permitted to harden.

If epoxy cement is used instead of hot melt, the broadhead 52 is installed as usual and alignment is then accomplished before the epoxy hardens. Once aligned, the arrow is left in the alignment device which then provides a jig to hold the shaft 50 and aligned head 52 in position until the epoxy hardens. Note that two notches 58 are provided on opposite edges of the bracket 32 so that a rubber band may be stretched between these notches 58 and across an arrow to hold it in place until the epoxy or other cement finishes curing.

With respect to a broadhead provided with an outsert for coupling the head with the arrow shaft, it should be appreciated that the alignment procedure is the same as described above except, of course, the outsert slips over and receives the end portion 54 of the shaft 50.

It is to be understood that while a certain form of this invention has been illustrated and described, it is not limited thereto except insofar as such limitations are included in the following claims and allowable equivalents thereof.

Having thus described the invention, what is claimed as new and desired to be secured by Letters Patent is as follows:

1. Apparatus for aligning an arrowhead with the longitudinal axis of an arrow shaft, said apparatus comprising:

a base, means on said base for establishing an alignment axis and for supporting an arrow shaft for rotation about said axis, a centering fixture of magnetic material having a recess therein for receiving an arrowhead, magnet means mounted on said base and spaced from said supporting means for holding said fixture at a location in general alignment with said axis with said recess positioned to receive the head of an arrow on said supporting means, and said fixture and said magnet means having contacting surfaces extending transversely of said axis to provide a floating mount for said fixture to permit it to seek a position aligning a received arrowhead with an associated rotatably supported arrow shaft.

2. The apparatus as claimed in claim 1, wherein said recess is tapered.

3. The apparatus as claimed in claim 1, wherein said recess is of generally cone-shaped configuration.

4. The apparatus as claimed in claim 1, wherein said magnet means is stationary.

5. The apparatus as claimed in claim 4, wherein said fixture is supported solely by said magnet means at said contacting surfaces.

6. The apparatus as claimed in claim 4, wherein said fixture comprises a block of said magnetic material having said recess therein and presenting one of said contacting surfaces.

7. The apparatus as claimed in claim 6, wherein said recess is of generally cone-shaped configuration.

* * * * *